US008967597B2

(12) United States Patent
Burns et al.

(10) Patent No.: US 8,967,597 B2
(45) Date of Patent: Mar. 3, 2015

(54) DEVICE FOR MIXING GAS INTO A FLOWING LIQUID

(75) Inventors: David Burns, Richmond Hill (CA); Jason Yeo, Richmond Hill (CA); Richard Lonetto, Richmond Hill (CA)

(73) Assignee: Blue Planet Environmental Inc., Richmond Hill, Ontario (CA)

( * ) Notice: Subject to any disclaimer, the term of this patent is extended or adjusted under 35 U.S.C. 154(b) by 1011 days.

(21) Appl. No.: 12/991,046

(22) PCT Filed: May 8, 2009

(86) PCT No.: PCT/CA2009/000637

§ 371 (c)(1), (2), (4) Date: Jan. 4, 2011

(87) PCT Pub. No.: WO2009/135315

PCT Pub. Date: Nov. 12, 2009

(65) Prior Publication Data

US 2011/0115105 A1 May 19, 2011

Related U.S. Application Data

(60) Provisional application No. 61/051,387, filed on May 8, 2008.

(51) Int. Cl.
*B01F 3/04* (2006.01)
*B01F 5/00* (2006.01)

(52) U.S. Cl.
CPC ..... *B01F 3/0446* (2013.01); *B01F 5/0068* (2013.01)
USPC ..... 261/79.2

(58) Field of Classification Search
CPC ..... B01F 3/0446; B01F 5/0068
USPC ..... 261/79.1, 79.2, 108
See application file for complete search history.

(56) References Cited

U.S. PATENT DOCUMENTS 1,089,406 A * 3/1914 Fitts ..... 239/116
1,780,573 A * 11/1930 Wager ..... 261/75

(Continued)

FOREIGN PATENT DOCUMENTS

| | | |
|---|---|---|
| EP | 0 112 197 | 6/1984 |
| JP | 3-153704 | 7/1991 |
| JP | 4-322731 | 11/1992 |

OTHER PUBLICATIONS

Office Action dated Oct. 3, 2013 in U.S. Appl. No. 12/867,926.

(Continued)

*Primary Examiner* — Charles Bushey
(74) *Attorney, Agent, or Firm* — Faegre Baker Daniels LLP

(57) ABSTRACT

A device for the mixing of a gas into a liquid comprises a hollow frustum shape housing having a central axis, extended from a small diameter fluid outlet end, defining a fluid outlet opening, to a large diameter end; a liquid inlet port positioned adjacent the large diameter end is formed in said housing which allows delivery of pressurized liquid into said hollow housing, and a helically cut conical member is positioned and affixed within the hollow center of the housing with its axis aligned with that of the hollow frustum shape housing such that fluid delivered into the housing forms a swirling motion around the outside of the conical member as it passes from inlet port to outlet opening. The housing has a gas inlet for delivery of gas to the fluid within the frustum shaped housing at a position adjacent to the fluid outlet opening as the fluid moves from inlet to fluid outlet opening.

20 Claims, 4 Drawing Sheets

(56) References Cited

U.S. PATENT DOCUMENTS

| | | | | | |
|---|---|---|---|---|---|
| 1,816,528 | A | * | 7/1931 | Haysel | 261/79.1 |
| 1,840,840 | A | * | 1/1932 | Goldsborough | 261/79.1 |
| 2,040,185 | A | * | 5/1936 | Riall | 261/79.1 |
| 2,776,862 | A | * | 1/1957 | Bloom | 239/116 |
| 2,886,297 | A | * | 5/1959 | Crandall | 366/76.91 |
| 3,332,231 | A | * | 7/1967 | Walsh | 60/274 |
| 3,395,899 | A | * | 8/1968 | Kopa | 261/22 |
| 3,584,701 | A | | 6/1971 | Freeman | |
| 3,692,245 | A | * | 9/1972 | Needham et al. | 239/488 |
| 3,775,314 | A | | 11/1973 | Beitzel et al. | |
| 4,271,099 | A | | 6/1981 | Kukla | |
| 4,344,711 | A | | 8/1982 | Kendall et al. | |
| 4,522,504 | A | | 6/1985 | Greverath | |
| 4,838,434 | A | | 6/1989 | Miller et al. | |
| 5,049,320 | A | | 9/1991 | Wang et al. | |
| 5,599,513 | A | | 2/1997 | Masaki et al. | |
| 5,770,062 | A | | 6/1998 | Isbell | |
| 6,103,128 | A | | 8/2000 | Koso et al. | |
| 7,547,002 | B2 | * | 6/2009 | Mao et al. | 261/78.1 |
| 2002/0066489 | A1 | | 6/2002 | Kampe | |
| 2011/0127682 | A1 | * | 6/2011 | Burns et al. | 261/79.2 |

OTHER PUBLICATIONS

Amendment dated Apr. 3, 2013 in U.S. Appl. No. 12/867,926.

Notice of Allowance dated Apr. 11, 2014 in U.S. Appl. No. 12/887,926.

* cited by examiner

DEVICE FOR MIXING GAS INTO A FLOWING LIQUID

CROSS-REFERENCE TO RELATED APPLICATION

This application is related to and claims the benefit under 35 U.S.C. §119 and 35 U.S.C. §365 of International Application No. PCT/CA2009/000637, filed May 8, 2009, the disclosure of which is expressly incorporated herein by reference.

FIELD OF THE INVENTION

This invention relates to an inline device for mixing gas into a flowing liquid. Amongst its applications, this device provides a means for efficiently dissolving oxygen in water and creating an air bubble in water suspension.

BACKGROUND OF THE INVENTION

The general need to thoroughly mix oxygen rich air into water is becoming more important as the public realize the benefits of oxygenated water. As this mixture is comprised of a plurality of microscopic bubbles in water, one of its exemplary benefits is that it is able to deliver actual oxygen rich gas to places normally submerged under water.

Traditional methods for mixing a gas into a liquid are described in the following patents:

- U.S. Pat. No. 3,775,314 "Method and apparatus for mixing gas with water" 1973
- U.S. Pat. No. 4,271,099 "Apparatus For Thorough Mixture of a Liquid with a Gas" 1981
- U.S. Pat. No. 4,838,434 "Air Sparged Hydrocyclone Apparatus and Methods for Separating Particles From a Particulate Suspension" 1989
- U.S. Pat. No. 5,049,320 "Gas Dissolving System and Method"
- U.S. Pat. No. 6,103,128 "Method and Apparatus for Mixing Gas with Liquid"

There exists a need for an improved method and apparatus for mixing gas into a flowing liquid over the devices disclosed in the prior art.

SUMMARY OF THE INVENTION

In accordance with an aspect of the invention there is provided an inline device for the thorough mixing of a gas into a liquid. This device is comprised of two components. The first of which is a housing of hollow frustum shape having a central axis, extended from a small diameter fluid outlet end, defining a fluid outlet opening, to a large diameter end; a liquid inlet port positioned adjacent the large diameter end is formed in said housing which allows delivery of pressurized liquid into said hollow housing, and a helically cut conical member is positioned and affixed within the hollow center of the housing with its axis aligned with that of the hollow frustum shape housing such that fluid delivered into the housing forms a swirling motion around the outside of the conical member as it passes from inlet port to outlet opening, said housing having a gas inlet for delivery of gas to the fluid within the frustum housing at a position adjacent to the fluid outlet opening as it moves from inlet to fluid outlet opening. The gas infused fluid passes through the frustum shape housing through the fluid outlet at the small diameter end and enters the interior space of the second component which is a containment shell. In one example embodiment, this containment shell completely encompasses the first component or in another example embodiment, simply collects the fluid leaving the first component outlet opening. Fluid entering the containment shell from the hollow frustum outlet collects in the containment shell and exits through a discharge port formed in the containment shell. The device is an inline device in the sense that pressurized fluid enters the fluid inlet and passes through the hollow frustum, at which point it is infused with gas, and then passes through its outlet, into the containment chamber and out the containment chamber outlet driven by an incoming pressurized fluid.

In accordance with a further aspect of the invention, the first component is of the frustum dispersion type having a housing forming a conical cavity, sealed at one large end, tapering to a discharge at the other end. There is a fluid inlet tangential to the cavity near the sealed end. There is a hollow, tapered helix cut cone shape ("The Unicorn") in the center of the cavity, affixed to the sealed end, with the point of the cone shape "Unicorn" axially aligned with the discharge orifice to help enable the continuous swirling motion of the contained fluid and to act as a gas inlet port to start the formation of a gas vortex. The fluid inlet of this first component receives pressurized fluid from a pumped source causing a fluid rotation inside the cavity. The fluid progressively gets pushed towards the first component discharge opening due to the constant inflow from the pump and as it approaches this discharge it is accelerated because of the reduction of area inside the cavity. The difference in density between the liquid and gas causes the denser swirling liquid to be pushed to the outer circumference and the less dense gas forms a cyclone at the vertex. The difference in velocities between the two phases causes shear between the liquid and gas. The net result is at the point of discharge from the first component the now thoroughly mixed suspension is heavily loaded with small bubbles of gas.

One of the advantages provided by the device of this invention over other gas dissolving apparatus is its ability to produce extremely fine bubbles which maximize many of the positive aspects of aeration and other types of gas dissolution.

This device of the herein invention provides a means of efficiently dissolving gas such as for example, oxygen in liquid, such as for example water and creating an air bubble in water suspension.

This device of the herein invention is particularly suited to the hydroponics industry as oxygen delivery to the roots of plants is critical to the plants health and growth rates. Highly oxygenated water is also key for aquatic life like fish and plants that require oxygen to survive and flourish. Use of this device to supply an aquarium with oxygen infused water, would allows for a higher density of oxygen consuming life forms in a fixed volume aquarium. Laundry and textile cleaning is another application which can benefit from highly oxygenated water and tiny air bubbles. The oxygen helps the soap clean better and the bubbles allow the soap to lather and penetrate deeper into the fabric and even rinse cleaner, allowing washing machines to reduced soap and water requirements.

BRIEF DESCRIPTION OF THE DRAWINGS

Reference to example embodiments of the invention will now be made in the accompanying drawings in which.

DETAILED DESCRIPTION OF THE INVENTION

Figure 1:
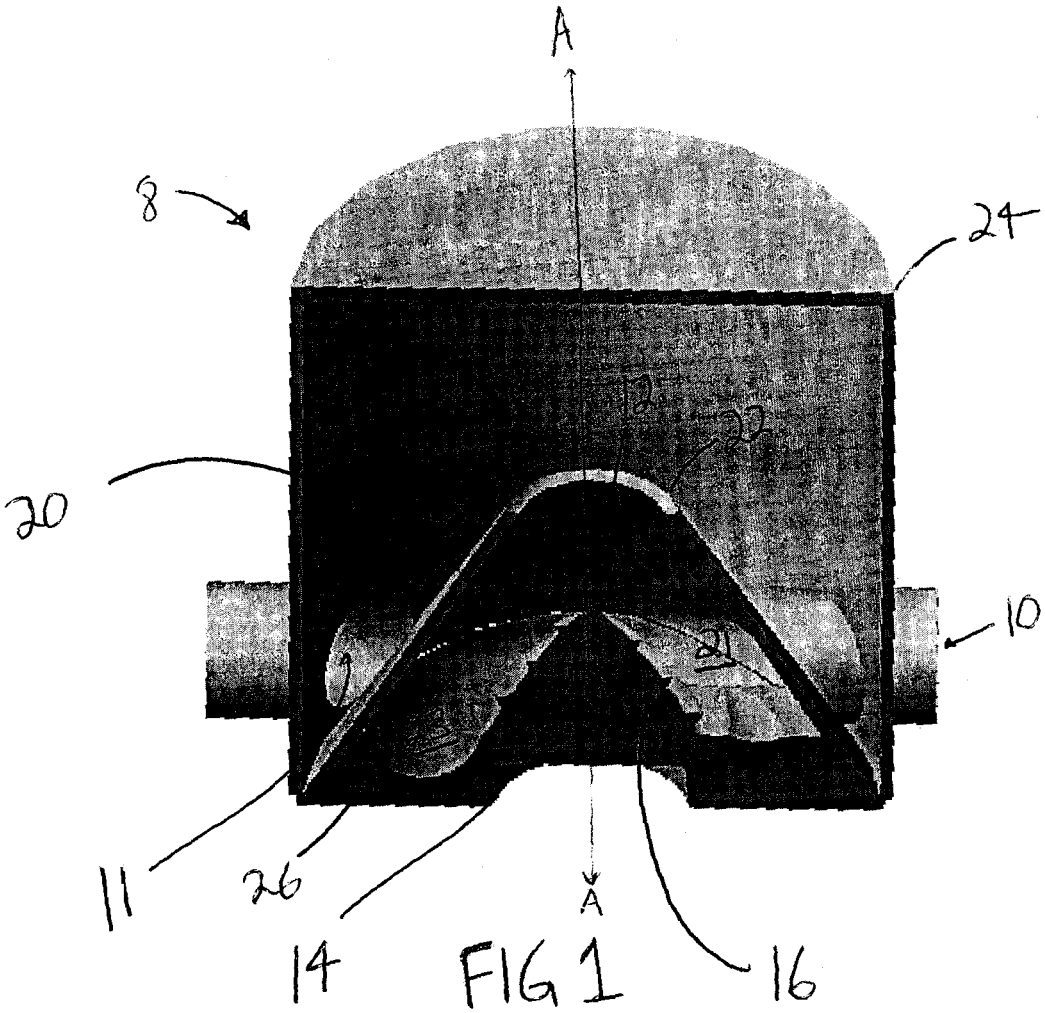
FIG. 1 is a vertical cut away view showing an example embodiment of the device having a containment shell embodiment encompassing the hollow frustum component.
Figure 2:
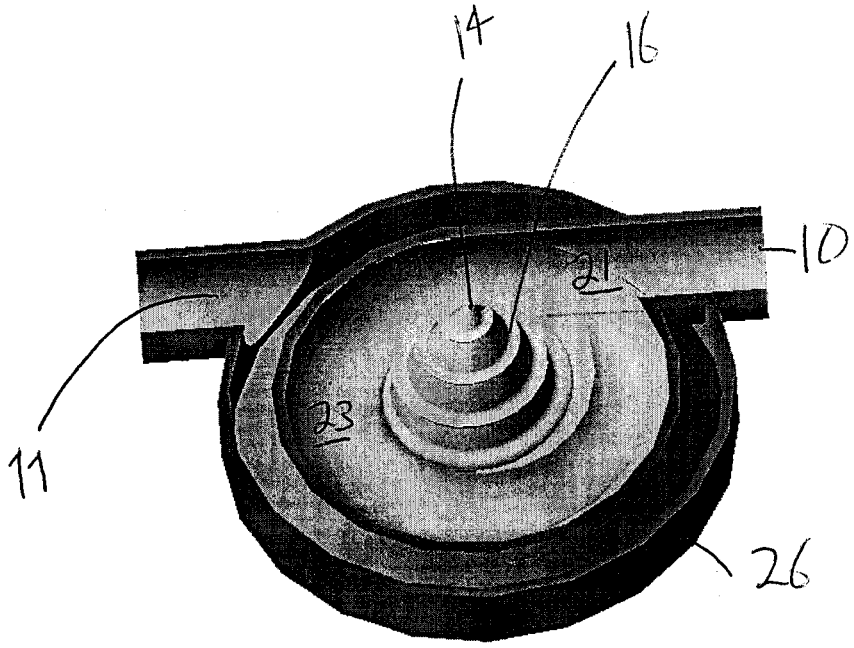
FIG. 2 is a horizontal cut away showing flow passages of the example embodiment of FIG. 1.

In the embodiments of invention illustrated, the Device (8) is made of plastic, resembling a cylinder with a defined fluid inlet (10) and hollow frustum discharge opening (12), containment shell discharge opening, a gas inlet (14), a frustum (20) defining an internal conical cavity, and an internal unicorn (16) with the frustum cavity, which assists in maximizing pressure and velocity gradients to ensure peak efficiency of gas infusion. Other suitable materials may be used for construction.

The embodiments of the device are made such that under normal operation it is connected inline being fed with a pressurized liquid through inlet (10) and discharging through an outlet (11) to a fixed connection into a pipe, line, or flexible hose.

The first component of the Devices is a frustum (20), with the smallest end (22) having a discharge opening (12) positioned into the containment shell (24). The axis of rotation is defined by the line drawn through the center of both parallel ends of the frustum (line A-A). The embodiment in the Figures shows the preferred ratio of frustum large diameter, small diameter and inlet, outlet size ratios for ideal injection of gas.

The frustum discharge can be equal in size to the inlet pipe (10) or it can be of another dimension. In an exemplary embodiment the frustum discharge (12) is 25% smaller than the inlet pipe (10) diameter.

The inlet pipe (10) can be of any size, but in an exemplary embodiment, is 35% of the large end diameter (26) of the frustum. The device of the invention may still function under different inlet and outlet ratios, but efficiency will vary and potentially be compromised if altered significantly.

The discharge outlet defined in the containment shell and discharge pipe (11) can be of any size but in exemplary embodiments is typically equal to that of the inlet pipe (10) size for ease of installation.

In an embodiment of the invention, the inlet pipe (10) enters the internal cavity of the frustum (20) at or near tangential to the inner curvature of the frustum. The inlet pipe (10) is positioned at or adjacent to the large diameter end (26) of the frustum. If the inlet pipe is not tangential to the inner curvature or is not near the large end of the frustum, the Device will continue to function, but may have reduced efficiency.

In the embodiments shown, the inlet pipe (10) allows fluid to pass into the cavity of the frustum, but the inlet pipe must not extend into the frustum, rather it should terminate at the wall of the frustum at a frustum inlet (21) because any objects other than The Unicorn structure in the frustum cavity will disrupt desired uniform flow and lower the performance of the unit.

The example frustum (20) of the Device serves the function of accepting the pressurized liquid (usually water) from a liquid source at the frustum inlet through the inlet pipe and creating a rotating body of fluid about an axis of rotation that is constantly being replenished at the same rate that it discharges.

The large diameter end of frustum (20) of the invention has a surface (23) which elevates as it extends around the circumference of the large diameter end. It has zero elevation with respect to the large diameter end in line with the frustum fluid inlet. This ramp follows and fills the space between the inner surface of the frustum cavity and the outer surface of The Unicorn structure. The ramp continues around the entire circumference of the unit until it terminates at the same point where it started (one rotation of the cavity). The total elevation of the ramp is usually about 10% of the height of the frustum. Depending on configuration, other ramp tapering may be used to lesser or more effect. The ramp serves the purpose of added acceleration and swirling motion of the fluid thus improving efficiency.

The frustum (20) of the device is tapered such that the rotating fluid is constantly pushed towards the discharge end (12) as new fluid is delivered to the device. The decreasing cross section of the frustum as it moves from inlet position to discharge position causes the velocity of the rotating fluid to increase in order to maintain continuous flow.

In the exemplary embodiments of the invention shown, inside the main cavity of the frustum, there is a helical grooved cone (22) (also referred to herein as "The Unicorn") whose base is directly affixed to the frustum large diameter end, co-axial with the axis of rotation (defined by line A-A). The shape and form of the Unicorn as a helical grooved cone feature helps accelerate the fluid rotation improving efficiency by reducing excessive turbulence and friction between bounding walls and the fluid.

The Unicorn has a gas inlet (14) orifice running axially from large diameter base of the frustum, through the Unicorn entering the frustum cavity adjacent the tip of the frustum for the purpose of gas injection directly into the lowest pressure area inside of the frustum cavity, which is adjacent the frustum outlet.

The gas will enter the frustum through the gas inlet extending through the Unicorn from the large diameter end of the frustum that is connected in a sealed manner to the large diameter end of the Unicorn. The gas will exit the Unicorn from the tip or small diameter end of the Unicorn.

The gas supply to the Unicorn can be connected either from a pressurized source or from one at atmospheric pressure. If the gas is connected to a pressurized source, the supply may need to be regulated to ensure optimal operation of the Device. If the gas is at atmospheric pressure, there has to be sufficient fluid supply to the device to create the required vacuum at the vortex in the axial center of the Device to overcome the pressure seen at the discharge of the unit. Typically, the device when fed liquid at 20 psi will create 5 PSI of relative vacuum.

Two embodiments of the containment shells of the herein invention are described below:

A first embodiment is seen in FIG. 1. The containment shell (24) is completely encompassing the frustum. The fluid inlet (10) to the frustum cavity passes thought the wall of the shell (24) and does not allow any inlet liquid to enter directly into the shell without first passing through the mixing frustum. After the gas/liquid mixture exits the frustum through outlet end it enters the containment shell cavity. The shell has only one exit (11) which discharges all the mixed fluid. The discharge can be located anywhere on the shell but depending on the mounting of the device should be as high as possible to prevent rising bubbles from forming a gas pocket.

Figure 3:
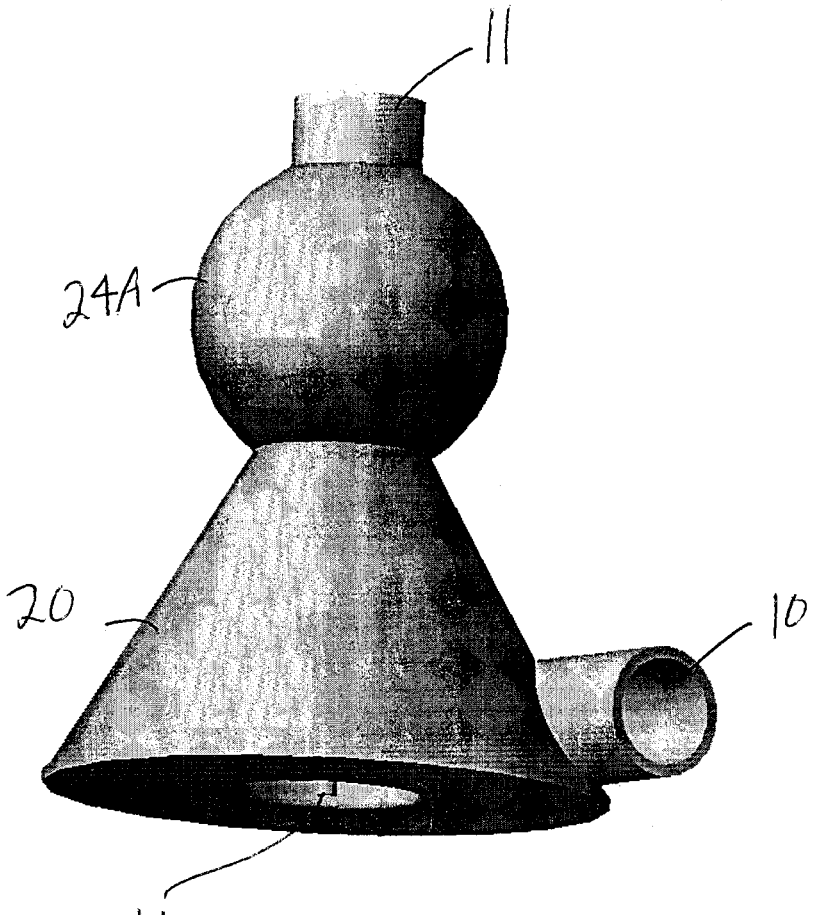
FIG. 3 is a perspective view of an alternate embodiment of the device of the invention, having a collection plenum.
Figure 4:
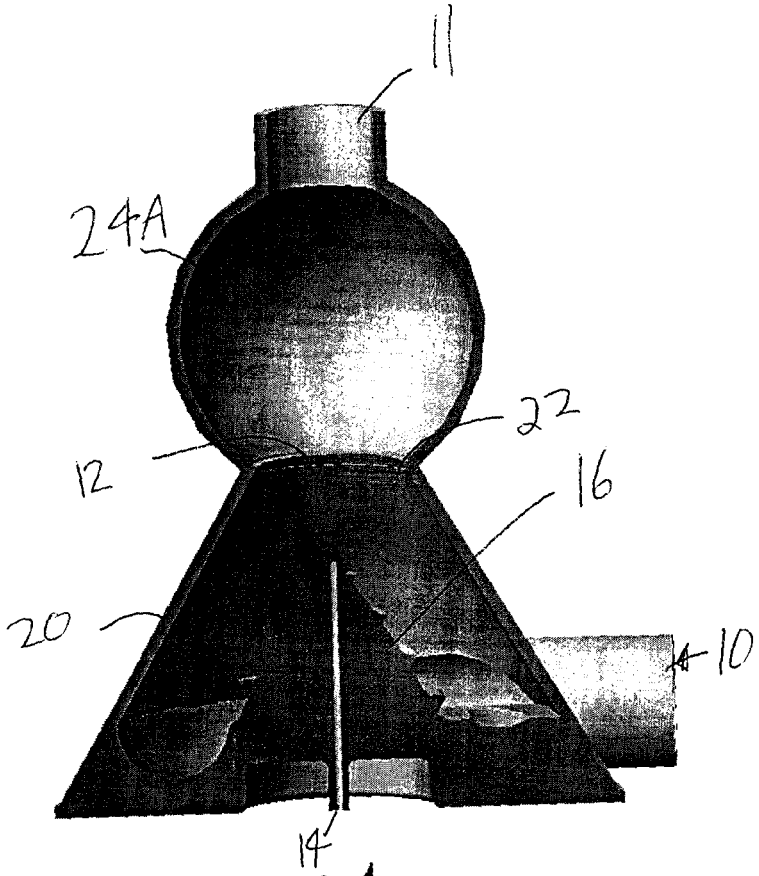
FIG. 4 is a vertical cut away view of the embodiment of FIG. 3, illustrating the basic shape and flow passages of this embodiment of the Device.

A second embodiment is seen in FIGS. 3 and 4. The containment shell (24A) is a spherical shape (or other similar shape) that sits adjacent the frustum, and efficiently collects all mixed fluid exiting the frustum. It should be of curved shape, such as shown, and sufficient diameter that it minimizes turbulence, thus reducing friction and increasing efficiency. As it extends away from the frustum, it then gradually reduces its cross sectional area to a discharge area (44), the exemplary embodiment being the same size as the inlet and has standard threads (or a flange) on the outside to allow for a connection to standard system tubing or piping. The device will still mix gas and liquid even if the discharge is of different diameter then the inlet but not as efficiently and it will require more modifications to the overall system being mixed.

It should be understood that many changes, modifications, variations and other uses and applications will become apparent to those skilled in the art after considering the specification and the accompanying drawings. Therefore, any and all such changes, modifications, variations and other uses and applications which do not depart from the spirit and the scope of the invention are deemed to be covered by the invention.

The invention claimed is:

1. A device for the mixing of a gas into a liquid comprising: a hollow frustum shaped housing having a central axis, extended from a small diameter fluid outlet end, defining a fluid outlet opening, to a large diameter end; a liquid inlet port positioned adjacent the large diameter end is formed in said housing which allows delivery of pressurized liquid into said hollow housing, and a helically cut conical member is positioned and affixed within the hollow center of the housing with its axis aligned with that of the hollow frustum shaped housing such that fluid delivered into the housing forms a swirling motion around the outside of the conical member as it passes from the inlet port to the outlet opening, said housing having a gas inlet for delivery of gas to the fluid, for forming a gas infused fluid within the frustum housing at a position adjacent to the fluid outlet opening as it moves from the inlet to the fluid outlet opening.

2. The device as recited in claim 1 wherein the gas infused fluid passes through the frustum shaped housing through the fluid outlet at the small diameter end and enters an interior space of a second component which is a containment shell in fluid communication with the fluid outlet, and which completely encompasses the frustum shape housing.

3. The device as recited in claim 1 wherein the gas infused fluid passes through the frustum shaped housing through the fluid outlet at the small diameter end and enters an interior space of a second component which is a containment shell in fluid communication with the fluid outlet, and which simply collects the fluid leaving the frustum shaped housing outlet opening, and exits through a discharge port formed in the containment shell.

4. The device as recited in claim 1, wherein the device comprises an inline device in the sense that a pressurized fluid enters the liquid inlet port and passes through the hollow frustum housing at which point it is infused with gas to form the gas infused fluid, and then passes through the outlet, wherein the device further comprises a containment chamber in fluid communication with the outlet of the housing, whereby the gas infused fluid passes through the outlet into the containment chamber and out a containment chamber outlet driven by an incoming pressurized fluid.

5. The device as recited in claim 1 wherein the frustum shaped housing forms a conical cavity, a sealed end at the large diameter end, tapering to the fluid outlet at the small diameter end and there is defined in the housing the liquid inlet port, the liquid inlet port tangential to the conical cavity near the sealed end, the device further comprising a hollow, tapered helix cut cone shape positioned in the center of the conical cavity, affixed to the sealed end, with a point of the cone shape axially aligned with a discharge opening to facilitate a continuous swirling motion of the contained fluid and to act as a gas inlet port to start the formation of a gas vortex.

6. The device of claim 5 wherein the liquid inlet port of the frustum shaped housing is in fluid communication with a pumped source, whereby the frustum shaped housing receives pressurized fluid from the pumped source causing a fluid rotation inside the cavity.

7. The device as recited in claim 1 wherein the fluid outlet of the hollow frustum shaped housing ranges in size from being equal in diameter to that of the liquid inlet port to 25% smaller than the liquid inlet port diameter.

8. The device as recited in claim 1 wherein the diameter of the liquid inlet port is approximately 35% of the large diameter end of the frustum shaped housing.

9. The device as recited in claim 1 wherein the liquid inlet port enters an internal cavity of the frustum shaped housing one of tangential and near tangential to the inner curvature thereof and the inlet port is positioned one of at the large diameter end and adjacent to the large diameter end.

10. The device as recited in claim 1 wherein the liquid inlet port allows fluid to pass into a cavity of the frustum shaped housing, with the inlet port terminating at the wall of the frustum shaped housing at a frustum inlet.

11. The device as recited in claim 2, wherein the device comprises an inline device in the sense that a pressurized fluid enters the liquid inlet port and passes through the hollow frustum housing at which point it is infused with gas to form the gas infused fluid, and then passes through the outlet, wherein the device further comprises a containment chamber in fluid communication with the outlet of the housing, whereby the gas infused fluid passes through the outlet into the containment chamber and out a containment chamber outlet driven by an incoming pressurized fluid.

12. The device as recited in claim 3, wherein the device comprises an inline device in the sense that a pressurized fluid enters the liquid inlet port and passes through the hollow frustum housing at which point it is infused with gas to form the gas infused fluid, and then passes through the outlet, wherein the device further comprises a containment chamber in fluid communication with the outlet of the housing, whereby the gas infused fluid passes through the outlet into the containment chamber and out a containment chamber outlet driven by an incoming pressurized fluid.

13. The device as recited in claim 2 wherein the fluid outlet of the hollow frustum shaped housing ranges in size from being equal in diameter to that of the liquid inlet port to 25% smaller than the liquid inlet port diameter.

14. The device as recited in claim 3 wherein the fluid outlet of the hollow frustum shaped housing ranges in size from being equal in diameter to that of the liquid inlet port to 25% smaller than the liquid inlet port diameter.

15. The device as recited in claim 4 wherein the fluid outlet of the hollow frustum shaped housing ranges in size from being equal in diameter to that of the liquid inlet port to 25% smaller than the liquid inlet port diameter.

16. The device as recited in claim 5 wherein the fluid outlet of the hollow frustum shaped housing ranges in size from being equal in diameter to that of the liquid inlet port to 25% smaller than the liquid inlet port diameter.

17. The device as recited in claim 6 wherein the fluid outlet of the hollow frustum shaped housing ranges in size from being equal in diameter to that of the liquid inlet port to 25% smaller than the liquid inlet port diameter.

18. The device as recited in claim 2 wherein the diameter of the liquid inlet port is approximately 35% of the large diameter end of the frustum shaped housing.

19. The device as recited in claim 3 wherein the diameter of the liquid inlet port is approximately 35% of the large diameter end of the frustum shaped housing.

20. The device as recited in claim 4 wherein the diameter of the liquid inlet port is approximately 35% of the large diameter end of the frustum shaped housing.

* * * * *